US009879922B2

(12) United States Patent
Bertilsson et al.

(10) Patent No.: US 9,879,922 B2
(45) Date of Patent: Jan. 30, 2018

(54) PLATE HEAT EXCHANGER

(71) Applicant: ALFA LAVAL CORPORATE AB, Lund (SE)

(72) Inventors: Klas Bertilsson, Eslöv (SE); Anders Nyander, Staffanstorp (SE); Alvaro Zorzin, Romans d'Isonzo (IT)

(73) Assignee: ALFA LAVAL CORPORATE AB, Lund (SE)

( * ) Notice: Subject to any disclaimer, the term of this patent is extended or adjusted under 35 U.S.C. 154(b) by 334 days.

(21) Appl. No.: 14/407,567

(22) PCT Filed: Jun. 11, 2013

(86) PCT No.: PCT/EP2013/061983

§ 371 (c)(1),
(2) Date: Dec. 12, 2014

(87) PCT Pub. No.: WO2013/186194

PCT Pub. Date: Dec. 19, 2013

(65) Prior Publication Data

US 2015/0122468 A1 May 7, 2015

(30) Foreign Application Priority Data

Jun. 14, 2012 (EP) ..... 12171917

(51) Int. Cl.
*F28F 9/00* (2006.01)
*F28F 9/02* (2006.01)
(Continued)

(52) U.S. Cl.
CPC ..... *F28F 9/00* (2013.01); *F25B 39/022* (2013.01); *F25B 39/028* (2013.01); *F28D 9/005* (2013.01); *F28F 9/027* (2013.01); *F28F 27/02* (2013.01)

(58) Field of Classification Search
CPC ..... F28D 9/0062; F28D 9/0006; F28D 9/005; F28F 9/00; F28F 9/0243; F28F 9/0248;
(Continued)

(56) References Cited

U.S. PATENT DOCUMENTS 5,651,268 A * 7/1997 Aikawa ..... F28F 9/027 138/44
5,806,586 A * 9/1998 Osthues ..... F28F 9/0273 165/153
(Continued)

FOREIGN PATENT DOCUMENTS

CN 101031762 A 9/2007
DE 100 24 888 A1 11/2001
(Continued)

OTHER PUBLICATIONS

English version of Office Action (Notice of Reasons for Rejection) dated Nov. 30, 2015, by the Japanese Patent Office in corresponding Japanese Patent Application No. 2015-516584. (5 pgs).
(Continued)

*Primary Examiner* — Dominick L Plakkoottam
*Assistant Examiner* — Raheena R Malik
(74) *Attorney, Agent, or Firm* — Buchanan Ingersoll & Rooney PC

(57) ABSTRACT

A plate heat exchanger includes a plate package having first and second heat exchanger plates. The plates are joined to each other and arranged side by side so that a first plate interspace exists between each pair of adjacent first and second heat exchanger plates, and a second plate interspace is formed between each pair of adjacent second and first heat exchanger plates. The first and the second plate interspaces are separated from each other and provided side by side in an alternating order. Substantially each heat exchanger plate has at least a first porthole forming a first inlet channel to the
(Continued)

first plate interspaces. At least two injectors are arranged in a wall portion of the first inlet channel and extend from the exterior of the plate package to the first inlet channel interior, and each injector supplies a fluid to more than one of the first plate interspaces.

20 Claims, 6 Drawing Sheets

(51) Int. Cl.
*F28F 27/02* (2006.01)
*F28D 9/00* (2006.01)
*F25B 39/02* (2006.01)

(58) Field of Classification Search
CPC ..... F28F 9/0273; F28F 9/027; F28F 27/02; F25B 39/022; F25B 39/028; B21J 5/066
USPC ..... 165/166, 167
See application file for complete search history.

(56) References Cited

U.S. PATENT DOCUMENTS 5,910,167 A * 6/1999 Reinke ..... F25B 39/028 165/174
5,950,715 A * 9/1999 Jonsson ..... F28D 9/005 165/103
6,168,765 B1 * 1/2001 Romatier ..... B01J 19/249 165/166
6,449,979 B1 * 9/2002 Nagasawa ..... F28D 1/0391 62/503
7,086,249 B2 * 8/2006 Bae ..... F25B 39/022 165/173
7,331,195 B2 * 2/2008 Bae ..... F25B 39/02 165/174
7,473,404 B2 1/2009 Chopard et al.
8,171,987 B2 * 5/2012 Jiang ..... F25B 39/028 165/174
8,225,853 B2 * 7/2012 Macri ..... F25B 39/028 165/174
9,074,383 B2 * 7/2015 McQueen ..... E04H 4/129
2006/0070399 A1 4/2006 Bae et al.
2010/0186924 A1 * 7/2010 Hiyama ..... F01P 7/165 165/10
2012/0061064 A1 3/2012 Strömer et al.
2015/0122468 A1 5/2015 Bertilsson et al.
2015/0135747 A1 5/2015 Bertilsson et al.
2015/0168075 A1 6/2015 Bertillsson et al.

FOREIGN PATENT DOCUMENTS

DE 10 2006 002018 A1 7/2007
EP 2 455 689 A2 5/2012
JP 51-83966 U 7/1976
JP 53-109166 U 9/1978
JP 08-504027 A 4/1996
JP 10-300384 A 11/1998
JP 2003-287321 A 10/2003
JP 2006162107 A 6/2006
JP 2011503509 A 1/2011
TW 232049 B 10/1994
WO 9414021 A1 6/1994

OTHER PUBLICATIONS

Office Action (Notice of Preliminary Rejection) dated Feb. 15, 2016, by the Korean Intellectual Property Office in corresponding Korean Patent Application No. 10-2015-7000540 and an English translation of the Office Action. (3 pgs).
Office Action issued on May 7, 2015, by the Taiwanese Patent Office in corresponding Taiwanese Patent Application No. 102121012, and an English Language Translation of the Office Action (26 pages).
International Search Report (PCT/ISA/210) dated Oct. 9, 2013, by the European Patent Office as the International Searching Authority for International Application No. PCT/EP2013/061983.
Written Opinion (PCT/ISA/237) dated Oct. 9, 2013, by the European Patent Office as the International Searching Authority for International Application No. PCT/EP2013/061983.

* cited by examiner

PLATE HEAT EXCHANGER

TECHNICAL FIELD

The present invention refers generally to a plate heat exchanger wherein at least two injectors are arranged in a wall portion of a first inlet channel, each injector being arranged to supply a first fluid to more than one of the first plate interspaces.

BACKGROUND ART

The present invention refers generally to a plate heat exchanger, in particular a plate heat exchanger in the form of an evaporator, i.e. a plate heat exchanger designed for evaporation of a cooling agent for various applications, such as air conditioning, cooling systems, heat pump systems, etc.

A plate heat exchanger, typically includes a plate package with a plurality, of first and second heat exchanger plates which are joined to each other and arranged side by side in such a way that a first plate interspace is formed between each pair of adjacent first heat exchanger plates and second heat exchanger plates and a second plate interspace between each pair of adjacent second heat exchanger plates and first heat exchanger plates. The first plate interspaces and the second plate interspaces are separated from each other and provided side by side of each other in an alternating order in the plate package. Substantially each heat exchanger plate has at least a first porthole and a second porthole, wherein the first portholes form a first inlet channel to the first plate interspaces and the second portholes form a first outlet channel from the first plate interspaces.

The cooling agent supplied to the inlet channel of such a plate heat exchanger for evaporation is usually present both in a gaseous state and a liquid state, i.e. it is a two-phase evaporator. It is then difficult to provide an optimum distribution of the cooling agent to the different plate interspaces in such a way that an equal quantity of cooling agent is supplied and flows through each plate interspace.

DE10024888 discloses one example of a well known solution to the distribution problem wherein the inlet port of each heat exchanger plate in the plate package comprises a distributor distributing the refrigerant from the inlet channel into the plate interspaces.

DE 10 2006 002 018 discloses one example of another well known principle to the distribution problem. The refrigerant supplied to the plate heat exchanger is distributed into the inlet channel from one end thereof and further into the plate interspaces via a nozzle arrangement. Two principles are shown regarding the nozzle arrangement. In the first principle the nozzle arrangement is in the form of a plurality of small holes arranged in the circumferential, longitudinal wall portion of the inlet channel. The small holes act as spray nozzles distributing the refrigerant into the plate interspaces. In the second principle a flute is arranged to extend inside and along the inlet channel. The flute is provided with plurality of holes acting as nozzles distributing the refrigerant along the inlet channel and further into the plate interspaces.

In this general prior art plate heat exchanger the cooling agent is introduced at one end of the longitudinal first inlet channel, i.e. the first port hole, for further distribution in the form of droplets along the first inlet channel and further into each of the individual first plate interspaces. First of all it is very hard to control the flow inside the first inlet channel. There is always a risk of that the energy content of the inserted fluid is too high, whereby a part of the flow supplied to the inlet channel via its inlet port will meet the rear end of the inlet channel and be reflected thereby in the opposite direction Thereby the flow in the inlet channel is very chaotic and hard to predict and control. Further, the pressure drop of the cooling agent increases with the distance from the inlet of the first inlet channel, whereby the distribution of cooling agent between the individual plate interspaces will be affected. Thereby it is hard to optimize the efficiency of the plate heat exchanger. It is also known that the angular flow change that the droplets of the cooling agent must undergo when entering the individual plate interspaces from the first inlet channel contributes to a pressure drop.

Generally the efficiency of a plate heat exchanger at part load is a raising issue for the purpose of reducing the energy consumption. By way of example, laboratory scale trials have shown that a cooling system relating to air-conditioning may save 4-10% of its energy consumption just by improved evaporator function at part load for a given brazed plate heat exchanger. Further, an evaporator system is typically only operating at full capacity for 3% of the time, while most evaporators are designed and tuned for a full capacity operation duty. More focus is put on how the evaporator performs at different operation duties instead of being measured at only one typical operation duty. Also, the market applies so called seasonal efficiency standards. The standards may vary between different states and regions. Typically, such standards are based on a consideration including different working loads, whereby most evaporators are designed and tuned in view of a specific standard. However, during normal operation the work load varies greatly and it hardly reflects the fictive conditions used for the standard.

SUMMARY

The object of the present invention is to provide an improved plate heat exchanger remedying the problems mentioned above.

Especially it is aimed at a plate heat exchanger which allows a better control and distribution of the supply of cooling agent along the first inlet channel and/or between the individual plate interspaces to thereby allow the efficiency of the plate heat exchanger to be improved.

A further object of the invention is to provide a plate heat exchanger which allows the supply of cooling agent to be varied and optimized depending on the actual operation duties.

This object is achieved by a plate heat exchanger including a plate package, which includes a number of first heat exchanger plates and a number of second heat exchanger plates, which are joined to each other and arranged side by side in such a way that a first plate interspace is formed between each pair of adjacent first heat exchanger plates and second heat exchanger plates, and a second plate interspace between each pair of adjacent second heat exchanger plates and first heat exchanger plates, wherein the first plate interspaces and the second plate interspaces are separated from each other and provided side by side in an alternating order in the at least one plate package, and wherein substantially each heat exchanger plate has at least a first porthole, wherein the first portholes form a first inlet channel to the first plate interspaces. The plate heat exchanger is characterized in that at least two injectors are arranged in a longitudinal wall portion of the first inlet channel, each injector being received in a through hole extending from the exterior of the plate package to the interior of the first inlet channel and each injector being arranged to supply a first fluid to more than one of the first plate interspaces.

In its general form, the present invention defines the use of at least two injectors arranged in a wall portion of the first inlet channel and each injector is arranged to supply a first fluid to more than one of the first plate interspaces. Thus, instead of supplying the first fluid, e.g. a cooling agent, to the first inlet channel via its single inlet port at one end of its longitudinal extension, a plurality of inlet points are provided in a wall portion defining the first inlet channel and along the longitudinal extension of the first inlet channel. The number of injectors is optional and their positions may be arbitrary for the purpose of providing a sufficient and even distribution along the longitudinal extension of the first inlet channel.

It is to be understood that the position of the at least two injectors in the wall portion is depending on the available space and design of the exterior wall portions of the plate package. This since the at least two injectors most conveniently may be provided in the wall portion by each injector being received in a through hole extending from the exterior of the plate package to the interior of the first inlet channel. This allows for a large degree of freedom when determining the position of the first inlet channel in a plate package. In most prior art plate heat exchangers, the inlet/outlet channels are arranged in the proximity of a corner. By the invention, this must not longer be the case.

By using more than one injector in the inlet channel, the prior art problems with chaotic, uncontrolled flow inside the inlet channel may be reduced or even eliminated. Further, by using more than one injector in the inlet channel, prior art problems relating to pressure drop when using only one single supply via the first inlet channel may be at least reduced or even eliminated, since the travelling distance for the supplied first fluid will be reduced. In fact, by the at least two injectors, the supply of the first fluid may be positioned close to or adjacent each or a plurality of plate interspaces. In case of the injectors being arranged adjacent each plate interspace, the negative impact to the pressure drop caused by the change of flow direction when entering the plate interspace may be reduced or even eliminated. The invention also provides for each plate interspace being supplied with the first fluid from more than one injector, and the injectors may have mutually different directions. This allows for a high utilization of the heat transferring area of each heat exchanger plate. This may in particular be useful for heat exchanger plates having large surface areas and thereby large heat transferring areas.

Thus, the present invention in its most general form provides a wide range of possibilities of how the first fluid, such as a cooling agent, is supplied, and especially where the first fluid is supplied into the plate heat exchanger. This provides for a better possibility in terms of control and optimization of the overall efficiency of the plate heat exchanger no matter its load.

The injectors may be arranged mutually in a number of ways. By way of example, the at least two injectors may be arranged side by side in a row in parallel with the longitudinal extension of the first inlet channel. The at least two injectors may alternatively be arranged side by side in at least two rows in parallel with the longitudinal extension of the first inlet channel. Further, the at least two rows of injectors may be arranged on each side of a longitudinal center line of the first inlet channel. Additionally, the injectors in a first row may be mutually displaced in view of the injectors in a second row.

The at least two injectors may be provided with a nozzle providing a spray pattern, such as a fan shaped or cone shaped, whereby the spray patterns of two adjacent nozzles in one row of injectors or in two adjacent rows of injectors may be set to have an overlap of 10-70%, more preferred 20-60% and most preferred 30-50%.

The term fan shaped and cone shaped spray pattern is used to describe an ejected flow from a nozzle. It is to be understood that a fan shaped spray pattern results in an essentially narrow rectangular projected area whereas a cone shaped spray pattern results in an essentially circular projected area. By the overlap, a substantially even distribution of the first fluid may be provided across the plurality of first plate interspaces, whereby each first plate interspace may be provided with essentially the same amount of first fluid and with essentially the same inherent energy content and essentially the same inherent density.

The overlap is generally to be calculated as seen on a portion of the envelope surface of the first inlet channel subjected to the spray pattern. In terms of a generally fan shaped spray pattern, the overlapping area provided by two adjacent spray nozzles has an essentially rectangular area. Likewise, in terms of a generally cone shaped spray pattern, the overlapping area provided by two adjacent spray nozzles corresponds to that of two partially overlapping circles. The overlap compensates at least partly for blur along the periphery of the spray pattern due to the spreading of the individual droplets comprised in the thus distributed fluid.

The at least two injectors may be arranged in the first inlet channel to direct a flow of fluid to the first plate interspaces via a part of the inner envelope surface of the first inlet channel, said part corresponding to, as seen in a cross section of the longitudinal envelope surface transverse the longitudinal extension of the first inlet channel, less than 75% of the cross section of the longitudinal envelope surface, more preferred less than 65% of the cross section of the longitudinal envelope surface and most preferred less than 50% of the cross section of the longitudinal envelope surface.

Accordingly, the first fluid may be supplied to only a portion of the envelope surface as seen in a cross section transverse the longitudinal extension of the first inlet channel. The portion to be selected depends on a number of factors such as the provision of and the position of any distributors adjacent the first inlet channel, the pressure of the supplied first fluid and any surface pattern on the individual heat exchanger plates. In one possible embodiment the fluid flow may be directed to a lower portion of the first fluid channel, whereby the first fluid when entering the first plate interspaces may be distributed across essentially the full heat transferring surface of the heat exchanger plates. Still, it is to be understood that this is only one, non-limiting example. It is also to be understood that one row of injectors may be directed to cover one portion of the cross section of the envelope surface, whereas another row of injectors may be directed to cover another portion of the cross section of the envelope surface. Further the surface area of the portion as such is determined by the spray pattern provided by each injector and any nozzle mounted thereto.

Each injector may be provided with an individual valve, or a group of injectors may be provided with a common valve. By the valve, the fluid supply to individual injectors or group of injectors may be controlled in order to allow better control of the efficiency of the heat exchanger. It is to be understood that in its easiest form the injectors may be constituted by valves distributing the first fluid.

The group of injectors may comprise injectors from at least two rows of injectors.

The first heat exchanger plates and the second heat exchanger plates may be permanently joined to each other.

The heat exchanger plates in the plate package may be connected to each other through brazing, welding, adhesive or bonding.

The through hole may be formed by plastic reshaping, by cutting or by drilling. The term plastic reshaping refers to a non-cutting plastic reshaping such as thermal drilling. The cutting or drilling may be made by a cutting tool. It may also be made by laser or plasma cutting.

The at least two injectors may be arranged to direct a supply of the first fluid essentially in parallel with the general plane of the first and the second heat exchanger plates.

The supply of the first fluid to the injectors may be controlled by a controller. This allows for the overall efficiency of the plate heat exchanger to be controlled with a very high efficiency no matter actual operation load. The injectors may be controlled individually or in groups.

BRIEF DESCRIPTION OF THE DRAWINGS

Embodiments of the invention will now be described, by way of example, with reference to the accompanying schematic drawings, in which FIG. 1 discloses schematically a typical side view of a plate heat exchanger.

DETAILED DESCRIPTION

For better understanding of the invention, an example of a typical plate heat exchanger 1 will be disclosed with reference to FIGS. 1-5. The plate heat exchanger 1 includes a plate package P, which is formed by a number of compression-moulded heat exchanger plates A, B, which are provided side by side of each other. The heat exchanger plates are disclosed as two different plates, which in the following are called the first heat exchanger plates A, see FIGS. 3 and 4, and the second heat exchanger plates B, see FIGS. 3 and 5. The plate package P includes substantially the same number of first heat exchanger plates A and second heat exchanger plates B.

Figure 3:
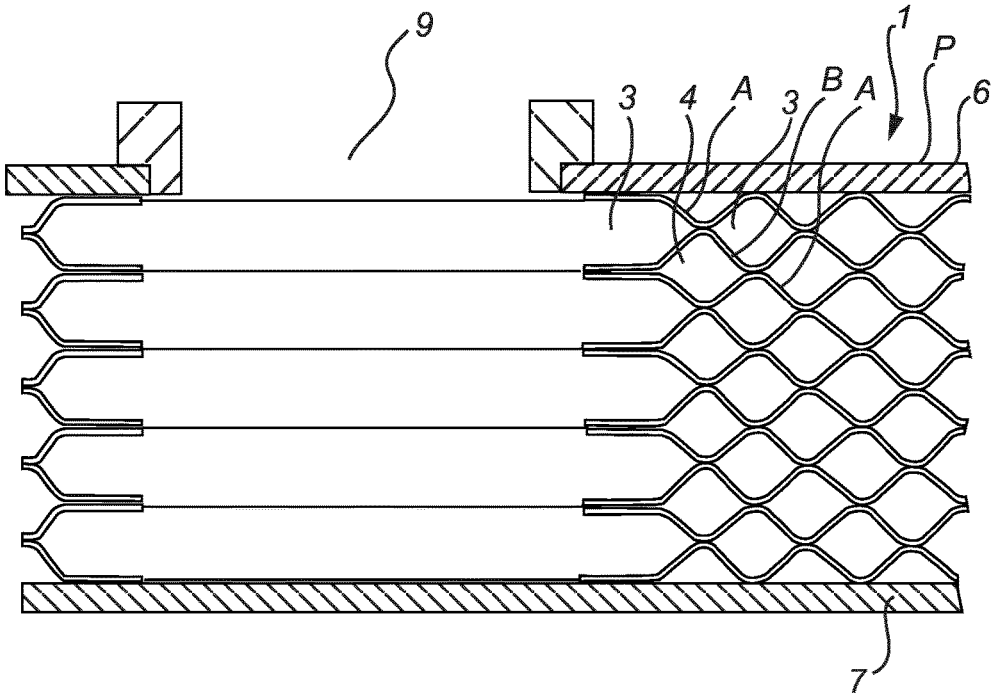
FIG. 3 discloses schematically a cross section of an inlet channel of a typical plate heat exchanger.

As is clear from FIG. 3, the heat exchanger plates A, B are provided side by side in such a way that a first plate interspace 3 is formed between each pair of adjacent first heat exchanger plates A and second heat exchanger plates B, and a second plate interspace 4 between each pair of adjacent second heat exchanger plates B and first heat exchanger plates A.

Every second plate interspace thus forms a respective first plate interspace 3 and the remaining plate interspaces form a respective second plate interspace 4, i.e. the first and second plate interspaces 3 and 4 are provided in an alternating order in the plate package P. Furthermore, the first and second plate interspaces 3 and 4 are substantially completely separated from each other.

The plate heat exchanger 1 may advantageously be adapted to operate as an evaporator in a cooling circuit (not disclosed). In such application, the first plate interspaces 3 may form first passages for a cooling agent whereas the second plate interspaces 4 may form second passages for a fluid, which is adapted to be cooled by the cooling agent.

The plate package P also includes an upper end plate 6 and a lower end plate 7, which are provided on a respective side of the plate package P and form the end plates of the plate package P.

In the embodiment disclosed, the heat exchanger plates A, B and the end plates 6, 7 are permanently connected to each other. Such a permanent connection may advantageously be performed through brazing, welding, adhesive or bonding.

Figure 1:
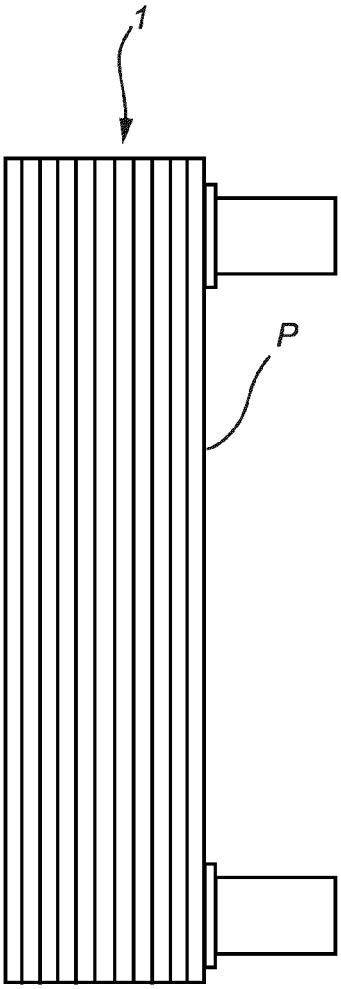
Figure 2:
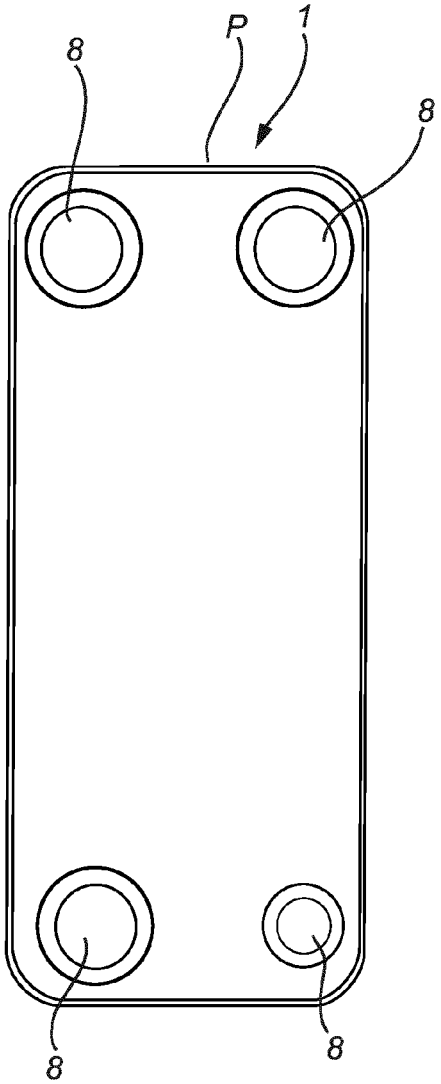
FIG. 2 discloses schematically a front view of the plate heat exchanger of FIG. 1.
Figure 4:
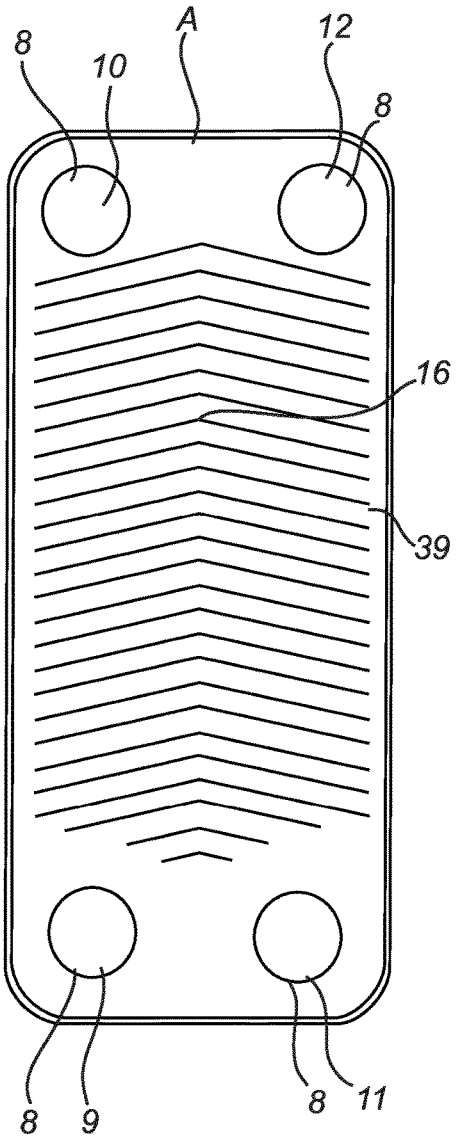
FIG. 4 discloses schematically a front view of a typical first heat exchanger plate.
Figure 5:
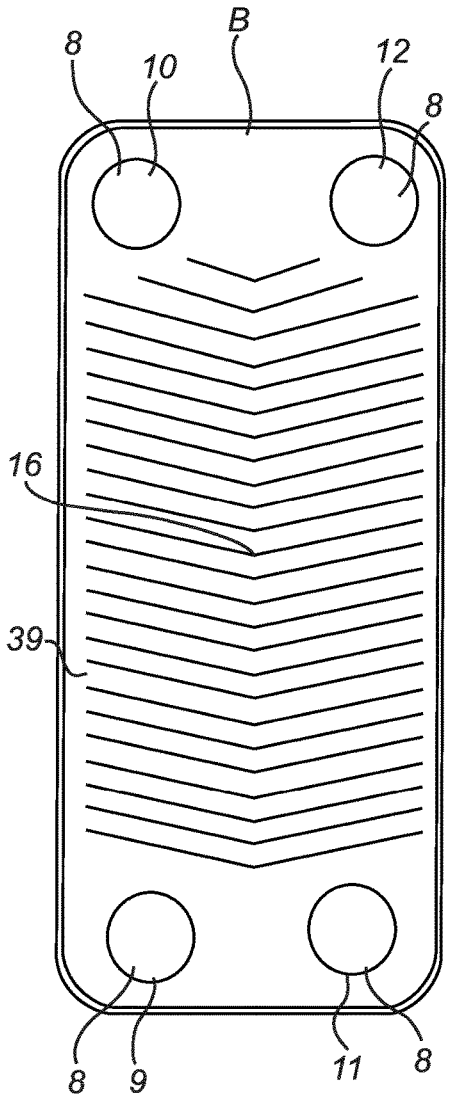
FIG. 5 discloses schematically a front view of a typical second heat exchanger plate.

As appears from especially FIGS. 2, 4 and 5, substantially each heat exchanger plate A, B has four portholes 8, namely a first porthole 8, a second porthole 8, a third porthole 8 and a fourth porthole 8. The first portholes 8 form a first inlet channel 9 to the first plate interspaces 3, which extends through substantially the whole plate package P, i.e. all plates A, B and the upper end plate 6. The second portholes 8 form a first outlet channel 10 from the first plate interspaces 3, which also extends through substantially the whole plate package P, i.e. all plates A, B and the upper end plate 6. The third portholes 8 form a second inlet channel 11 to the second plate interspaces 4, and the fourth portholes 8 form a second outlet channel 12 from the second plate interspaces 4. Also these two channels 11, 12 extend through substantially the whole plate package P, i.e. all plates A, B and 6 except for the lower end plate 7. The four portholes 8 are in the disclosed embodiment provided in the proximity of a respective corner of the substantially rectangular heat exchanger plates A, B. It is however to be understood that other positions are possible, and the invention should not be limited to the illustrated and disclosed positions.

Figure 6:
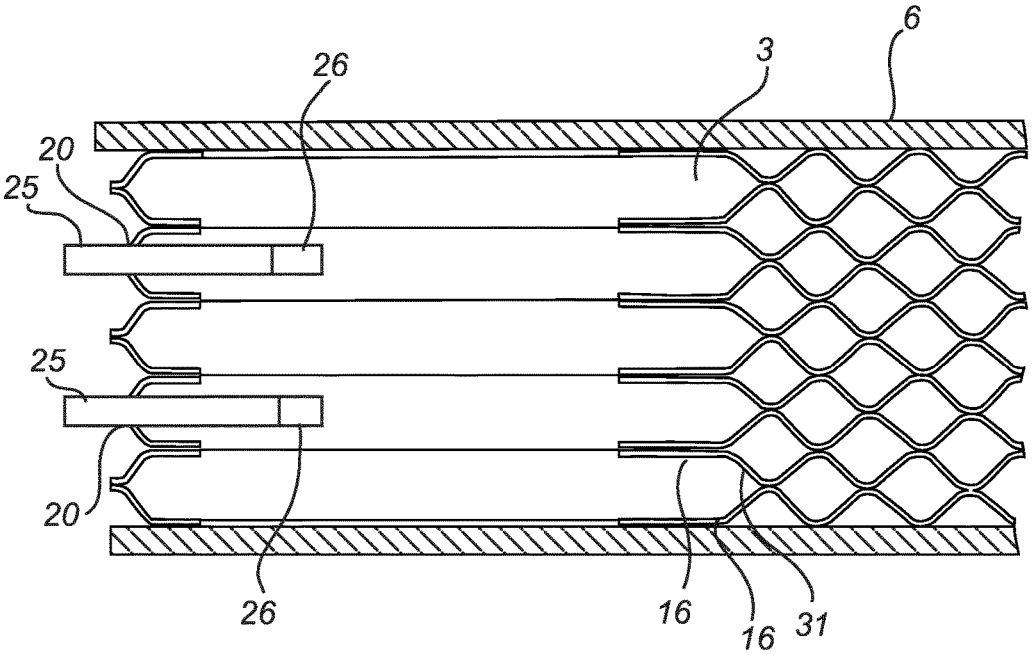
FIG. 6 illustrates a cross section of a plate package with a plurality of injectors according to the invention.

Now referring to FIG. 6, one example of the positioning of injectors 25 in view of the first inlet channel 9 will be discussed. In the disclosed embodiment, two injectors 25 are disclosed as arranged side by side perpendicular to the longitudinal extension LC of the first inlet channel 9. The injectors 25 are evenly distributed along the longitudinal extension LC of the first inlet channel 9 whereby each injector 25 is provided to supply the first fluid to a plurality of first plate interspaces 3.

Each of the at least two injectors 25 is arranged in a through hole 20 having an extension from the exterior of the plate package P to the first inlet channel 9, the through hole 20 may be formed by plastic reshaping, by cutting or by drilling. The term plastic reshaping refers to a non-cutting plastic reshaping such as thermal drilling. Thermal drilling is also known as flow drilling, friction drilling or form drilling. The cutting or drilling may be made by a cutting tool. It may also be made by laser or plasma cutting. The through hole 20 as such may be provided with a bushing, sealing or the like (not shown) to ensure a fluid tight connection.

The number of first plate interspaces 3 served by one and the same injector 25 may vary. The dimensioning parameter is essentially the requirement of an even distribution across the plate interspaces 3 to be served by the specific injector 25. It is to be understood that influencing parameters are by way of example spray pattern, the distance between a nozzle 26 of the injector 25 and the entrance to the plate interspace 3 and fluid pressure.

Figure 7:
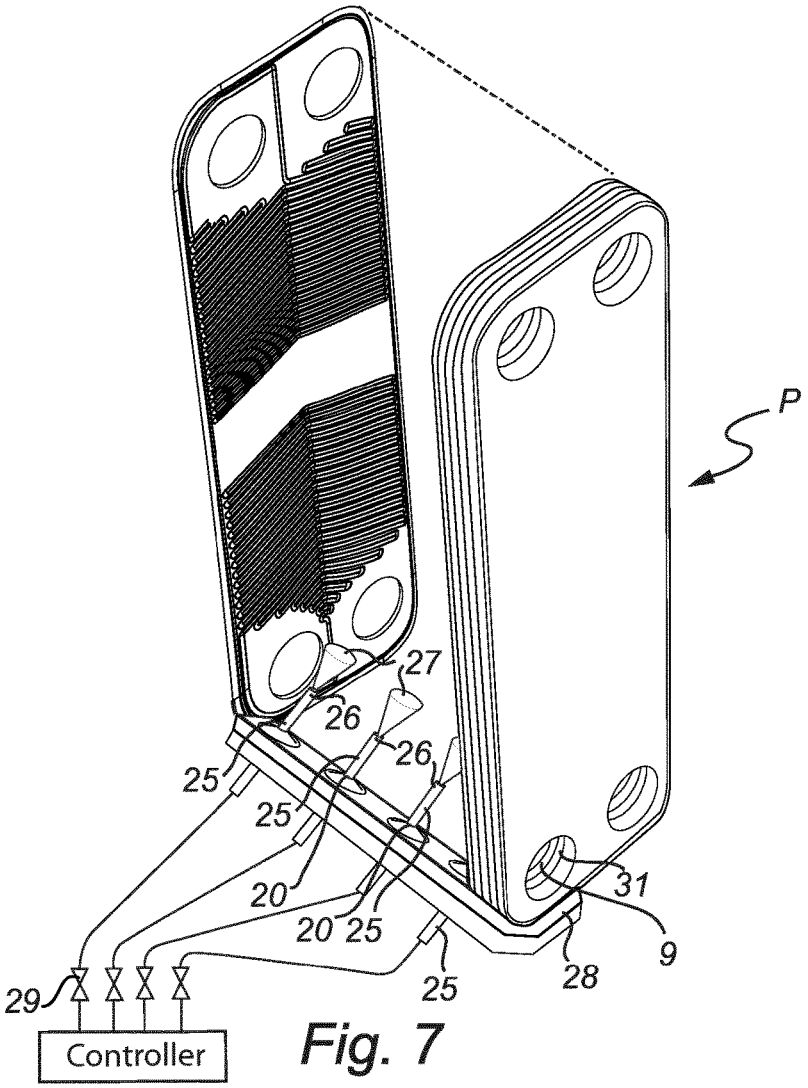
FIG. 7 illustrates a cross section of a plate package with a plurality of injectors according to the invention.

Now turning to FIG. 7, the same principle is disclosed when applied to a plate package P. For better understanding, a plurality of heat exchanger plates in the middle of the plate package P have been removed. In the disclosed embodiment, the injectors 25 are provided with nozzles 26 providing an essentially cone shaped spray pattern 27. Further, the injectors 25 are disclosed as being mounted to the plate package P via a holder 28. The holder 28 is attached to the exterior of the plate package P as one module and fixed there to. The individual injectors 25 are received in through holes 20 in the wall of the plate package P. The injectors 25 are disclosed as connected to valves 29, which in turn are communicating with a controller. In the disclosed embodiment each injector 25 is provided to communicate with one valve 29. It is however to be understood that one valve 29 may arranged to communicate with a plurality of injectors 25. It is also to be understood that the injectors as such may be constituted by valves. The valves 29 may be controlled individually or as a group by the controller. The evaporator in FIG. 7 is disclosed without end plates whereby the first inlet channel 9 is disclosed as a through channel.

In the following a number of different patterns of the injectors will be exemplified.

Figure 8A:
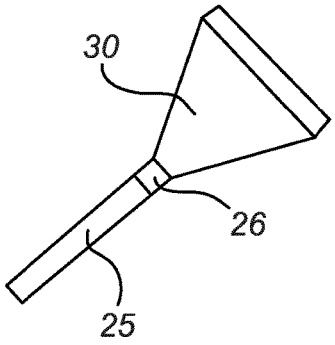
FIG. 8*a*, 8*b* illustrate embodiments of a fan shaped spray pattern.
Figure 8B:
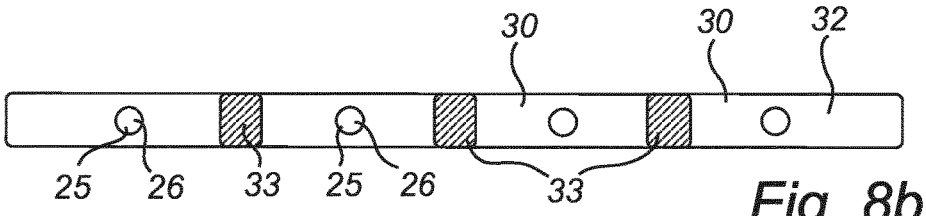

The injectors 25 may be provided with nozzles 26 providing a fan shaped spray pattern 30, see FIG. 8*a*. Thus, the resulting spray pattern, see FIG. 8*b* when projected on a surface, such as the inner envelope surface 31 of the first inlet channel 9, is an essentially rectangular projected area 32. The injectors 25 may be arranged with such mutual interspace along the first inlet channel 9 and with such distance to an inner envelope surface 31 of the inlet channel 9 that the spray patterns of two adjacent nozzles 26 provide an overlap 33. By the overlap 33, a substantially even distribution of the first fluid may be provided across a plurality of first plate interspaces 3. Generally, the purpose of an overlapping spray pattern is to compensate for blur along the periphery of the spray pattern due to the spreading of the individual droplets comprised in ejected fluid. The overlap 33 may be set to be in the range of 10-70%, more preferred 20-60% and most preferred 30-50% of the projected area.

Figure 9:
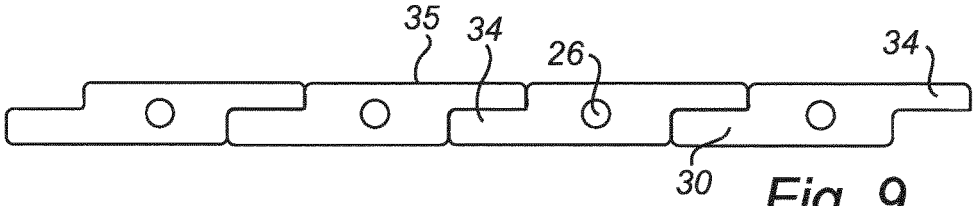
FIG. 9 illustrates a second embodiment of a fan shaped spray pattern.

FIG. 9 discloses another example of a spray pattern provided with nozzles 26 providing a fan shaped spray pattern 30. The projected surface area from each nozzle 26 can be seen as a rectangular with projections 34 in opposite directions. Two such adjacent projections 34 will provide a homogenous continuous bead-like pattern 35. Although no overlapping is disclosed, it should be understood that it is possible.

Figure 10:
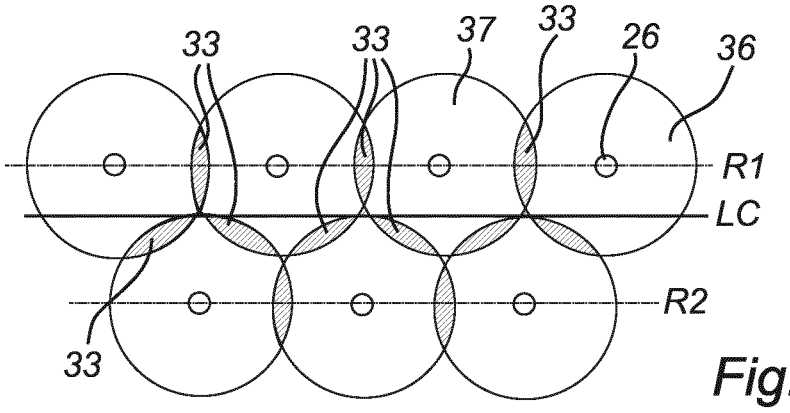
FIG. 10 illustrates a third embodiment of a cone shaped spray pattern.

As illustrated in FIG. 10, another embodiment is disclosed wherein the injectors are arranged side by side in two rows R1, R2. The disclosed spray pattern is the result of injectors provided nozzles 26, each providing an essentially cone shaped spray pattern 27, such as that disclosed in FIG. 7, whereby the resulting projected area will be circles 37. Although two rows R1, R2 are disclosed, it is to be understood that more than two rows R1, R2 are applicable, or only one row R1. The two rows R1, R2 are illustrated as arranged on each side of a longitudinal center line LC of the first inlet channel 9. However, it is to be understood that the rows R1, R2 may be arranged on the same side of the longitudinal center line LC. In the disclosed embodiment, the injectors 25 in the first row R1 are disclosed as being mutually displaced in view of the injectors in the second row R2. Further, the projected spray pattern is provided with an overlap 33.

Figure 11:
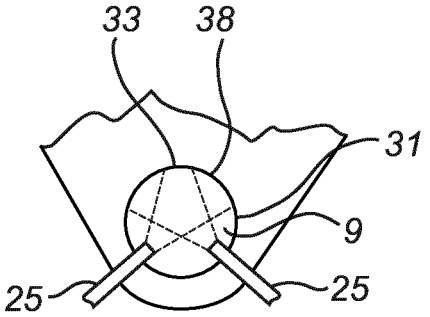
FIG. 11 discloses a schematic cross section of the first inlet channel with two injectors arranged on opposite sides of the longitudinal center axis of the inlet channel.

Referring to FIG. 11 one embodiment is disclosed wherein, as seen in a cross section of the first inlet channel 9, two injectors 25 are arranged to direct a fluid flow into the first inlet channel 9. The two injectors 25 are arranged on opposite sides of the longitudinal center axis LC of the inlet channel 9. The spray patterns from the two injectors 25 are partly overlapping 33 each other. Still, it should be known that no overlapping is required. The two injectors 25 direct a fluid flow to the first plate interspaces (not disclosed) via a part of the inner longitudinal envelope surface 31 of the first inlet channel 9. The projected part 38 may correspond to less than 75% of the cross section of the longitudinal envelope surface 31, more preferred less than 65% of the cross section of the longitudinal envelope surface 31 and most preferred less than 50% of the cross section of the longitudinal envelope surface 31. The portion selected depends on a number of factors such as the provision of and the position of any distributors (not disclosed) adjacent the first inlet channel 9, the pressure of the supplied first fluid and any surface pattern 39 on the individual heat exchanger plates A, B. The flow of the first fluid may by way of example be directed to the lower portion of the first fluid channel, whereby the first fluid when entering the first plate interspaces may be distributed across essentially the full heat transferring surface of the heat exchanger plates. Still, it is to understood that this is only one, non-limiting example.

Figure 12:
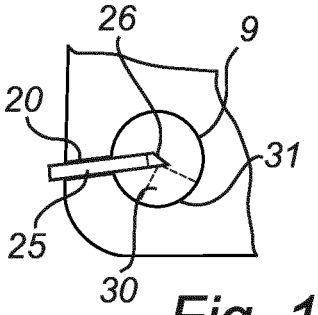
FIG. 12 discloses schematically a cross section of the inlet channel, wherein an injector is mounted to extend, via a through hole, into the inlet channel.

FIG. 12 discloses schematically a cross section of the first inlet channel 9, wherein an injector 25 is mounted to extend, via a through hole 20 into the first inlet channel 9. The injector 25 is provided with a nozzle 26 providing a fan shaped spray pattern 30 in a direction towards the lower part of the interior envelope surface 31 of the first inlet channel 9.

It is to be understood that the at least two injectors may be arranged to direct the supply of the first fluid in any arbitrary direction within the first inlet channel 9. This is especially the case if the injectors 25 are provided with atomizing nozzles. However, it is preferred that the flow is directed essentially in a direction in parallel with a general plane 16 of the first and the second heat exchanger plates A, B, see FIG. 4, 5, 6. Thereby any, undue re-direction of the flow may be avoided.

The invention has been illustrated and disclosed throughout this document with the port holes 8 and thereby also the first inlet channel 9 arranged in the corners of rectangular heat exchanger plates. It is however to be understood that also other geometries and positions are possible within the scope of protection.

The port holes 8 have generally been illustrated and disclosed as circular holes. It is to be understood that also other geometries are possible within the scope of the protection.

The invention has generally been described based on a plate heat exchanger having first and second plate interspaces and four port holes allowing a flow of two fluids. It is to be understood that the invention is applicable also for plate heat exchangers having different configurations in terms of the number of plate interspaces, the number of port holes and the number of fluids to be handled.

The four portholes 8 are in the disclosed embodiment provided in the proximity of a respective corner of the substantially rectangular heat exchanger plates A, B. It is to be understood that other positions are possible, and the invention should not be limited to the illustrated and disclosed positions.

Figure 13:
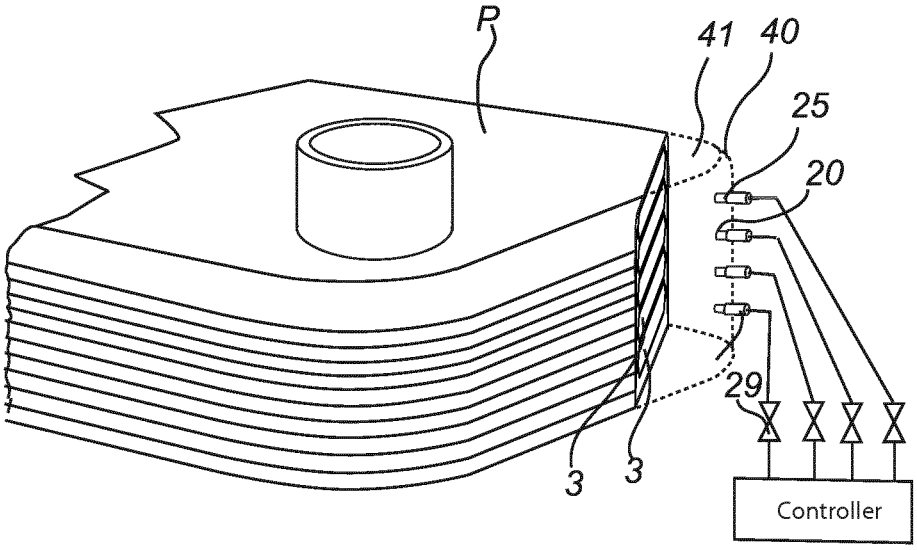
FIG. 13 discloses one embodiment wherein a first inlet channel is provided by a casing mounted to the plate package.

Yet another embodiment is disclosed in FIG. 13 wherein a corner portion of the plate package P has been cut off. A casing 40 is mounted to the plate package P to extend along the cut-off portion to thereby delimit, together with the plate package P, a channel 41 being in direct communication with the first plate interspaces 3. In this embodiment, the casing 40 together with the cut-off portion of the heat exchanger plates making up the plate package P can be seen as defining the channel 41 and first portholes, A plurality of injectors 25 are received in through holes 20 arranged in a wall portion of the casing 40. Each injector 25 is communicating with a valve 29 and the valves 29 are in communication with a controller. Each injector 25 may be provided with a nozzle. It is also to be understood that the injectors as such may be constituted by valves.

The first and second heat exchanger plates may be provided with distributors (not disclosed) for the purpose of providing a throttling of the first fluid in the transition area between the first inlet channel and the individual first plate interfaces. Thereby a pressure drop of the cooling agent is obtained when it enters the respective first plate interspace. This may further enhance the distribution of the first fluid across the area of the first plate interspace. The distributors may be arranged in a number of ways and a few examples will be given below.

The first and second heat exchanger plates may have distributors integrated in the heat exchanger plates. The distributors may by way of example, be formed as a pressed profile in the heat exchanger plates around or adjacent the first port hole, whereby the pressed profile as such acts as a distributor. The distributors may also by way of example be a pressed profile provided with through holes acting as distributors. It is also possible to have distributors arranged between the pairs of adjacent first and second heat exchanger plates in the area in or around the first port holes. Such distributor may be in the form of a profile loosely received between a pair of first and second heat exchanger plates, or a profile joined to one of the two heat exchanger plates forming a pair. Such distributor may be provided with trough holes or be provided with recesses which together with the heat exchanger plates act as distributors.

It is to be understood that the invention is applicable also to plate heat exchangers of the type (not disclosed) where the plate package is kept together by tie-bolts extending through the heat exchanger plates and the upper and lower end plates. In the latter case gaskets may be used between the heat exchanger plates. The invention is also applicable to plate heat exchangers (not disclosed) comprising pairwise permanently joined heat exchanger plates, wherein each pair forms a cassette. In such solution gaskets are arranged between each cassette.

The invention is not limited to the embodiment disclosed but may be varied and modified within the scope of the following claims, which partly has been described above.

The invention claimed is:

1. A plate heat exchanger including a plate package, which includes a number of first heat exchanger plates and a number of second heat exchanger plates, which are joined to each other and arranged side by side in such a way that a first plate interspace is formed between each pair of adjacent first heat exchanger plates and second heat exchanger plates, and a second plate interspace between each pair of adjacent second heat exchanger plates and first heat exchanger plates, wherein the first plate interspaces and the second plate interspaces are separated from each other and provided side by side in an alternating order in the at least one plate package, and wherein each of said number of first heat exchanger plates and each of said number of second heat exchanger plates has at least a first porthole passing through the respective heat exchanger plate, wherein the first portholes are aligned with one another and form a first inlet channel to the first plate interspaces, wherein at least two injectors are arranged in a longitudinal wall portion of the first inlet channel, each injector being received in a through hole extending from the exterior of the plate package to the interior of the first inlet channel defined by the aligned first porthole and each injector being arranged to supply a first fluid to more than one of the first plate interspaces.

2. A plate heat exchanger according to claim 1, wherein the at least two injectors are arranged side by side in a row in parallel with the longitudinal extension of the first inlet channel.

3. A plate heat exchanger according to claim 1, wherein the at least two injectors are arranged side by side in at least two rows in parallel with the longitudinal extension of the first inlet channel.

4. A plate heat exchanger according to claim 3, wherein the at least two rows of injectors are arranged on each side of a longitudinal center line of the first inlet channel.

5. A plate heat exchanger according to claim 3, wherein the injectors in a first row are mutually displaced in view of the injectors in a second row.

6. A plate heat exchanger according to claim 1, wherein the at least two injectors are provided with a nozzle providing a spray pattern, whereby the spray patterns of two adjacent nozzles in one row of injectors or in two adjacent rows of injectors are set to have an overlap of 10-70%.

7. A plate heat exchanger according to claim 1, wherein the at least two injectors are arranged in the first inlet channel to direct a flow of fluid to the first plate interspaces via a part of the inner longitudinal envelope surface of the first inlet channel, said part corresponding to, as seen in a cross section of the envelope surface transverse the longitudinal extension of the first inlet channel, less than 75% of the cross section of the longitudinal envelope surface.

8. A plate heat exchanger according to claim 1 wherein each injector is provided with an individual valve or wherein a group of injectors are provided with a common valve.

9. A plate heat exchanger according to claim 8, wherein the group of injectors comprises injectors from at least two rows of injectors.

10. A plate heat exchanger according to claim 1, wherein the first heat exchanger plates and the second heat exchanger plates are permanently joined to each other.

11. A plate heat exchanger according to claim 1, wherein the heat exchanger plates in the plate package are connected to each other through brazing, welding, adhesive or bonding.

12. A plate heat exchanger according to claim 1, wherein the through hole being formed by thermal reshaping, by cutting, by drilling or by cold forming.

13. A plate heat exchanger according to claim 1, wherein the at least two injectors are arranged to direct a supply of the first fluid parallel with the general plane of the first and the second heat exchanger plates.

14. A plate heat exchanger according to claim 1, wherein the supply of the first fluid to the injectors is controlled by a controller.

15. A plate heat exchanger according to claim 1, wherein the at least two injectors are provided with a nozzle providing a spray pattern, whereby the spray patterns of two adjacent nozzles in one row of injectors or in two adjacent rows of injectors are set to have an overlap of 30-50%.

16. A plate heat exchanger according to claim 1, wherein the at least two injectors are arranged in the first inlet channel to direct a flow of fluid to the first plate interspaces via a part of the inner longitudinal envelope surface of the first inlet channel, said part corresponding to, as seen in a cross section of the envelope surface transverse the longitudinal extension of the first inlet channel, less than 50% of the cross section of the longitudinal envelope surface.

17. A plate heat exchanger according to claim 1, wherein the spray pattern provided by the nozzle of each injector is a fan-shaped spray pattern or a cone-shaped spray pattern.

18. Use of a plate heat exchanger comprising:

supplying a first fluid to a plurality of injectors, the plate heat exchanger including a plate package comprising plural first heat exchanger plates and plural second heat exchanger plates, which are joined to each other and arranged side by side in such a way that a first plate interspace is formed between each pair of adjacent first heat exchanger plates and second heat exchanger plates, and a second plate interspace between each pair of adjacent second heat exchanger plates and first heat exchanger plates, the first plate interspaces and the second plate interspaces being separated from each other and provided side by side in an alternating order in the at least one plate package, each of the plural first heat exchanger plates and each of the plural second heat exchanger plates including a first porthole passing through the respective heat exchanger plate, the first portholes being aligned with one another to form a first inlet channel to the first plate interspaces; and injecting the first fluid from the plurality of injectors directly into the first inlet channel formed by the aligned first portholes to supply the first fluid to more than one of the first plate interspaces by way of the aligned first portholes.

19. A plate heat exchanger including a plate package, which includes a plurality of first heat exchanger plates and a plurality of second heat exchanger plates, which are joined to each other and arranged side by side in such a way that a first plate interspace is formed between each pair of adjacent first heat exchanger plates and second heat exchanger plates, and a second plate interspace between each pair of adjacent second heat exchanger plates and first heat exchanger plates, wherein the first plate interspaces and the second plate interspaces are separated from each other and provided side by side in an alternating order in the at least one plate package, the plate package also including two end plates provided on opposite sides of the plate package and between which all of the first and second heat exchanger plates are located, each of the plurality of first heat exchanger plates and each of the plurality of second heat exchanger plates including a first porthole that are aligned with one another to form a first inlet channel fluidly connected to the first plate interspaces, the first porthole of each of the first and second heat exchanger plates passing through the respective heat exchanger plate, and first and second injectors configured to supply a first fluid to more than one of the first plate interspaces by way of the first inlet channel, the first injector being received in a first through hole in a longitudinal wall portion of the first inlet channel, the second injector received in a second through hole in the longitudinal wall portion of the first inlet channel, the first and second through holes being spaced apart from one another along the longitudinal wall portion, the first and second through holes also being spaced from and positioned between the two end plates, the first and second through holes extending from the exterior of the plate package to the interior of the first inlet channel.

20. A plate heat exchanger according to claim 19, wherein the first and second injectors are positioned side by side in a row that is parallel to the longitudinal extent of the first inlet channel.

* * * * *